United States Patent [19]

Lafforgue et al.

[11] 4,206,182

[45] Jun. 3, 1980

[54] PROCESS FOR THE CHEMICAL TREATMENT OF URANIFEROUS ORES CONTAINING SULFUR COMPOUNDS AND/OR ORGANIC COMPONENTS BY ALKALINE LEACHING

[75] Inventors: Paul J. Lafforgue, Bessines sur Gartempe; Jean Grenier, Limoges; Guy Rivoire, Bessines sur Gartempe, all of France

[73] Assignee: Compagnie Generale Des Matieres Nucleaires (COGEMA), Paris, France

[21] Appl. No.: 876,156

[22] Filed: Feb. 8, 1978

[30] Foreign Application Priority Data

Feb. 8, 1977 [FR] France ..... 77 03486

[51] Int. Cl.[2] ..... C22B 60/02

[52] U.S. Cl. ..... 423/17; 423/3; 423/551

[58] Field of Search ..... 423/17, 3, 551, 658.5

[56] References Cited

U.S. PATENT DOCUMENTS

| | | | |
|---|---|---|---|
| 2,654,653 | 10/1953 | Nye et al. | 423/17 |
| 2,950,951 | 8/1960 | Sherk | 423/17 X |
| 2,964,380 | 12/1960 | Kolodney | 423/17 |
| 2,979,378 | 4/1961 | Koble | 423/17 |
| 2,992,887 | 7/1961 | Thuanes et al. | 423/17 |
| 3,022,135 | 2/1962 | Hart | 423/17 |
| 3,081,147 | 3/1963 | Koble | 423/17 |
| 3,105,734 | 10/1963 | Hart | 423/17 |
| 3,210,151 | 10/1965 | Koble | 423/17 |
| 3,708,206 | 1/1973 | Hard | 423/17 X |
| 3,792,903 | 2/1974 | Rhoades | 423/17 X |

FOREIGN PATENT DOCUMENTS

| | | | |
|---|---|---|---|
| 772867 | 4/1957 | United Kingdom | 423/17 |

OTHER PUBLICATIONS

Jovanovik, M. et al. "Alkaline Leaching of Uranium from Coal Ashes," Prog. Nuc. Energy, Series III, Process Chem. vol. III, pp. 13-20, 1961.

*Primary Examiner*—Richard E. Schafer
*Attorney, Agent, or Firm*—Ernest G. Szoke

[57] ABSTRACT

The invention relates to a process for the treatment of an uraniferous ore containing sulfur in the form of sulfates or sulfides with one or more alkaline solutions containing sodium carbonate in the presence of an oxidant, for extracting uranium in the form of soluble uranium salt in said solution.

It comprises subjecting the ore, in a first step, to the action of a dilute pre-leach solution of sodium carbonate, whose concentration does not substantially exceed, or by very little, that which is required for the solubilization of the major part of the sulfur initially contained in the ore to convert it to sulfate in the presence of the oxidant and, in a second step, to the action of a leach solution, more concentrated in sodium carbonate, enabling the extraction and solubilization in the medium of the major part of the uranium still contained in the ore, not extracted in the pre-leach medium of the first step.

26 Claims, 2 Drawing Figures

PROCESS FOR THE CHEMICAL TREATMENT OF URANIFEROUS ORES CONTAINING SULFUR COMPOUNDS AND/OR ORGANIC COMPONENTS BY ALKALINE LEACHING

The invention relates to a process for the extraction of uranium from uraniferous ores containing sulfur in the form of sulfide, sulfate or both. It is also applicable to ores containing in addition organic reducing matter or components comprising particularly organic acids, of the type denoted by the expression "humic acids", and which, by alkaline attack and oxidation, yield soluble "humates".

It is well known to the specialist that most of the processes for the chemical treatment of uraniferous ores, generally brought beforehand to a divided state by grinding or any other similar process, belong to either one of two distinct categories.

To the first category belong the so-called "acid processes" which comprise treating the ore with acid solutions, generally based on sulfuric acid and containing generally also an oxidizing agent. These processes are most commonly used because of the very aggressive character of these solutions with respect to the ore.

However, in the case of limestone-containing ores, or of ores which generally contain high proportions of carbonates, the acid processes bring into play considerable amounts of sulfuric acid, since large proportions of the latter are then consumed by the natural carbonates present in the ore.

Nonetheless the acid process often remains preferred, even for the treatment of ores containing non-negligible proportions of carbonates, in spite of the disadvantage that the overconsumption of sulfuric acid represents, when they possess non-negligible contents of organic matter or components. The oxidizing character of the treatment leach-solutions must then be all the more active as the reducing character of these organic materials is marked, taking into account the necessary conversion, well known to the man skilled in the art, of the often tetravalent uranium of these ores, to hexavalent uranium, to enable the later transformation of this metal into constituents solubilizable in the treatment leach solutions.

The processes belonging to the second category mentioned above make use of alkaline leach solutions, essentially based on sodium carbonates, often both sodium acid carbonate (also termed bicarbonate) and sodium neutral carbonate. These processes, also designated as "alkaline processes", which must also be carried out under oxidizing conditions, aim at converting the uranium of the ore into sodium uranyl-tricarbonate, which then dissolves in the alkaline leach solution. The reaction brought into play may be represented by the following chemical equation:

$$UO_2+\tfrac{1}{2}O_2+Na_2CO_3+{}_2NaCO_3=Na_4UO_2(CO_3)_3+H_2O$$

It is known that the uranium may then be recovered from these alkaline leach solutions or liquors, if need be after a previous dilution, for instance upon precipitating it by sodium hydroxide.

The following chemical equations are representative of the reactions involved:

$$Na_4UO_2(CO_3)_3+{}_4NaOH=Na_2UO_4+{}_3Na_2CO_3+{}_2H_2O$$

$${}_2Na_4UO_2(CO_3)_3+{}_6NaOH=Na_2U_2O_7+{}_6Na_2CO_3+H_2O$$

The alkaline processes exhibit a greater extraction selectivity with respect to the uranium than the acid processes, and consequently require a reduced number of subsequent purification steps of the uranium extracted. It is however well known that alkaline processes are much less aggressive, and this even under severe operating conditions, particularly under high pressure and temperature.

Further an increase of the carbonate concentration will also result in leach liquors loaded with uranium the concentration in sodium carbonates of which is then too high for the uranium to be separable therefrom by precipitation with sodium hydroxide under good conditions. It is then necessary either to considerably increase the sodium hydroxide consumption or to previously dilute the alkaline liquor. Whatever the solution adopted, it will adversely affect the yield.

In addition, the organic components, particularly when they contain acids having a reductor activity, in other words reducing acids, tend to be dissolved also in the alkaline treatment liquors, whence an extremely important pollution factor of the uranium subsequently recovered from these liquors.

In the same way, the alkaline process is difficult to apply to ores having high sulfur contents, whether in the form of sulfates or of sulfides. Certainly, when these sulfides are sufficiently crystalline, a conventional method consists of separating them by flotation and by treating them separately by an acid method for, in practically all cases, a part of the uranium is entrained in the sulfide concentrate. The sulfides not separated by this treatment or, a fortiori, the whole of these sulfides in the absence of any prior separation treatment, are themselves converted into sulfates in the course of the oxidizing treatment, for example according to the following chemical equation, when iron sulfides of the $FeS_2$ type are concerned:

$${}_2FeS_2+{}_{7,5}O_2+{}_8Na_2CO_3+{}_7H_2O={}_2Fe(OH)_3+{}_4Na_2SO_4+{}_8NaHCO_3$$

The alkaline treatment liquors then tend to become loaded with sulfate which, by a well known salt effect, will interfere with the extraction of the uranium. The greater the loading of the liquor with sulfates, the more important the mentioned salt effect, particularly after successive recycling of the leach liquors to the ore extraction step, whence the need to purge the installation often, and the production of effluents containing essentially sodium sulfate, whose important polluting action is known. In addition, considerable losses of sodium carbonate are induced, which burden the profitability of the process to a particularly great extent.

It will be appreciated that these drawbacks will even become cumulative when the ore contains both sulfur which is difficult to separate by a physical process and organic components, whereby conventional alkaline processes would prima faciae seem fraught with so many difficulties so as to be merely given up. This would appear to be the case with, by way of example, ores such as those which are found in the Herault area (France) and which contain both:

carbonates (essentially conventional dolomites or a ferruginous dolomite of the ankerite type), under contents expressed as $CO_2$, ranging from 5 to 10% by weight;

organic components the contents of which can also range from about 1 to about 5% by weight, and which comprise constituents with a more or less marked graphitic character, hydrocarbons as well as various organic components, particularly "humic acids";

sulfides (pyrites and pyrrhotite) of which only a small part is separable by flotation;

sulfates, and probably sulfur bound to organic components.

It is an object of the invention to overcome to a great extent the drawbacks which have been indicated above as regards the alkaline processes, notably to render them applicable to ores having high contents of sulfur and, possibly too, of organic matter or components.

It is another object of the invention to provide an alkaline process, which, whilst still having the qualities of selectivity particular to this type of process with respect to the uranium values, is essentially capable of being applied without excessive losses of the expensive constituents of the alkaline extraction or leaching solutions, in particular sodium carbonate, and this, even when it is applied to ores having high contents in sulfur and organic components, for instance such as those which have been indicated by way of example.

Other objects and advantages of the process according to the invention will be apparent from the description which follows.

The improvement according to the invention to the process of treatment of uranium ore by means of alkaline solutions based on sodium carbonate, in the presence of an oxidizing agent or oxidant, notably gaseous, such as air or an oxygen-containing gas, for example oxygen-enriched air, is characterized by a two-step uranium extraction, the ore being subjected, in a first step, to the action of a dilute pre-leach solution of sodium carbonate, whose concentration does not substantially exceed, or by very little, that which is required for dissolving a major portion of the sulfur initially contained in the ore and converting it into sulfates, in the presence of the oxidant, then, in a second step, to the action of a leach solution, more concentrated in sodium carbonate, enabling the extraction and the solubilization in the medium of a major part of the uranium still contained in the ore, not extracted in the pre-leach liquor of the first step.

For the sake of convenience the expressions "pre-leach solutions" and "leach solutions" will hereafter designate the solutions which are brought into contact with the ore to be treated and the expressions "pre-leach liquors" or "leach liquors" will designate the solutions which are obtained at the end of the pre-leaching or leaching operations respectively, after separation of the treated ore impoverished in sulfates and uranium.

The process according to the invention may be applied in the same manner to uraniferous ores containing also reducing organic components.

By way of example, the process according to the invention may be applied with success to an ore containing more than 0.5%, for example from about 0.6 to about 1% by weight of sulfur and more than 1%, notably from about 1 to about 5% by weight of organic components.

The invention takes advantage of the differentiated behaviors which have been observed of the essential constituents of the treated ores with respect to sodium carbonate solutions.

Particularly it has been found that a major proportion of the sulfates are extractible from the ore by means of relatively dilute solutions of sodium carbonate.

This two-step process is advantageous in several respects. It has in fact been noted that a major portion of the sulfur in the free or combined state that the ore originally contained, is extracted in the form of sulfates, upon subjecting the ore, in the first step, to a pre-leach solution having a content of sodium carbonate such that the liquor obtained at the end of the pre-leaching has a residual concentration of carbonate, ranging from about 10 to about 20 g per liter.

Such carbonate concentration then also provides optimal conditions for a most efficient precipitation of the uranium already extracted by this pre-leach liquor with sodium hydroxide.

At the level of the second step, the extraction of the uranium remaining in the ore is then facilitated as a result of the high reduction in sulfur contents which the ores underwent in the first step. In addition, the highly carbonated solutions used in this second step can be recycled several times for leaching new loads of ore having previously undergone the abovesaid first step pre-leaching, without being rapidly loaded with sodium sulfate, whence a possibility of an increased useful conversion yield of the sodium carbonate that they contain, thus an increased extracted uranium yield in relation to a then smaller total amount of sodium carbonate required to that effect.

The contents of organic components happen to be only little affected by the first step of the invention. Advantage is however taken of the different solubilization kinetics, which have been observed, or uranium, on the one hand, and of the organic components on the other hand, in concentrated solutions of sodium carbonate, for extracting the major part of the uranium contained in the ore, without, at the same time, causing considerable proportions of organic components to become solubilized in the alkaline liquor.

As is explained in more detailed manner hereafter, in connection with FIG. 1 of the drawings, it has been found that the uranium proportion extracted from the ore varies initially rapidly, as a function of its time of contact with the alkaline solution and then slows down when the leaching time is prolonged. On the other hand, the proportions of extracted organic components, which remain relatively low in the first period following the placing in contact of the solution with the ore, tend to increase more rapidly upon prolonging said contact. Consequently it becomes possible to extract the major part of the uranium, still contained in the ore in the course of the second step, before considerable amounts of organic matter have had time to be dissolved in the medium.

The duration of contact of the ore with the concentrated leach solution of sodium carbonate, in the second step of the process according to the invention, will certainly, in practice, depend on the contents of the treated ores in the various constituents which have been envisaged. It must however be noted that it is generally rather short. In practice, it is possible to consider that the time necessary for extracting about 95% of the uranium remaining in the ore, is less than that required for the extraction of about 25% by weight of the extractable organic matter initially contained in the ore. In most instances contact times ranging from about three to about twelve hours, at a temperature comprised between about 100° C. and about 140° C. will be effective for the purpose of extracting most of the uranium with but little organic contamination. Generally it is advantageous to operate the leaching step at a temperature ranging from about 120° C. to about 140° C., during from about 3 to about 7 hours.

Preferably, the concentration of sodium carbonate of the pre-leach solution ranges initially from about 20 to about 40 g per liter, and that of the leach solution from about 70 to about 110 g per liter of sodium carbonate.

This sodium carbonate may in fact comprise from 0 to 50% approximately of sodium acid carbonate and from 50 to about 100% of sodium meutral carbonate (percentages expressed as sodium equivalents).

The initially dilute solution of sodium carbonate used at the level of the first step, may however not contain acid sodium carbonate, since the latter tends to be formed as a result of the reaction between the sulphides, the oxygen and the sodium carbonate. There may also follow, when the alkalinity is provided by the acid sodium carbonate only, an interruption of the oxidation of the sulphur containing compounds. This may be prevented in accordance with an additional improvement of the invention, upon adjusting the pH of the pre-leach solutions by means of a controlled introduction into the latter, of an hydroxide, preferably of an alkaline-earth metal, in order to convert at least part of the soluble humic acids or humates into humates which are insoluble in the alkaline liquors at such pH values.

Preferably, these pH values are adjusted to a value from about 9.5 to about 10.

Calcium hydroxide is a particularly suitable hydroxide for achieving the above mentioned purpose. Advantageously, the calcium hydroxide concentrations in the pre-leach solutions are adjusted permanently to range from about 10 to about 30 g/l.

The reactions brought into play may be represented by the following chemical equations:

$$2FeS_2 + 7{,}5O_2 + 8Na_2CO_3 + 7H_2O = 2Fe(OH)_3 + 4Na_2SO_4 + 8NaHCO_3$$
$$8NaHCO_3 + 4Ca(OH)_2 = 4CaCO_3 + 4Na_2CO_3 + 8H_2O$$
$$2FeS_2 + 7{,}5O_2 + 4Na_2CO_3 + 4Ca(OH)_2 = 2Fe(OH)_3 + 4CaCO_3 + 4Na_2SO_4 + H_2O$$

According to yet another additional advantageous feature of the invention, one at least of the abovesaid pre-leach and leach solutions contains an amount of iron carbonate, iron hydroxide, or of a salt capable of releasing iron hydroxide in the medium in a sufficient amount to enable an increase of the amount of uranium extracted from the ore in the course of the corresponding operations. It has in fact been observed that these iron salts had a favorable effect on the uranium extraction kinetics.

The amounts of iron hydroxide or of iron salts (expressed as iron hydroxide equivalents per ton of treated ore) advantageously range from about 5 to about 40 kgs; more particularly from about 5 to about 15 kgs of iron hydroxide, or from about 10 to about 30 kg of iron carbonate, for example siderite, per ton of ore.

Advantageously, the whole of the process is carried out continuously, the major part if not all of the solution resulting from the pooling of the liquor obtained at the end of the pre-leach operation, after separation of the treated ore, and of the washings of this ore, being then recovered for the direct production of uranium. The latter may then be recovered by direct precipitation with sodium hydroxide under optimal conditions, if care is taken to adjust the initial content of the pre-leach solutions to a value such that the liquor obtained at the end of the pre-leach operation has a sodium carbonate content ranging from about 10 to about 20 g per liter.

The pre-leach solution itself is advantageously constituted by a solution resulting from the pooling of the washings of the ore, after separation, particularly filtration, of the second step-leach liquor, which may then be recycled to the second step-leach of additional ore.

As a matter of fact, it is known that the ore still contains considerable proportions of liquid, for example of the order of 0.35 $m^3$ of solution per ton of ore, in a more or less absorbed state, after separation, particularly filtration of the pre-leach or leach liquors. The preferred process embodiment indicated hereabove thus enables the recovery of the substantial amounts, both of the uranium and of sodium carbonate, which would otherwise be lost with the washings.

In the case of a continuous operation of an installation operated with the process according to the invention, it is particularly advantageous to adjust the volumes of the aqueous solutions used for the washings, having regard to the mass of ore treated in the second step, such that the solution resulting from their pooling will have a concentration of sodium carbonate corresponding substantially to that required for the pre-leach solution. The latter, in a continuously operating system, may hence be constituted, at least in part, by the solution resulting from the pooling of the washings of the ore at the level of the second step.

Further features of the invention will appear also in the course of the description which follows of various examples in support of the various observations which have been made within the scope of the invention, and of a complete flow-sheet embodying the process according to the invention. Reference will be made to the drawings.

I—STUDY OF THE SOLUBILIZATION KINETICS

(1) Operational conditions

Figure 1:
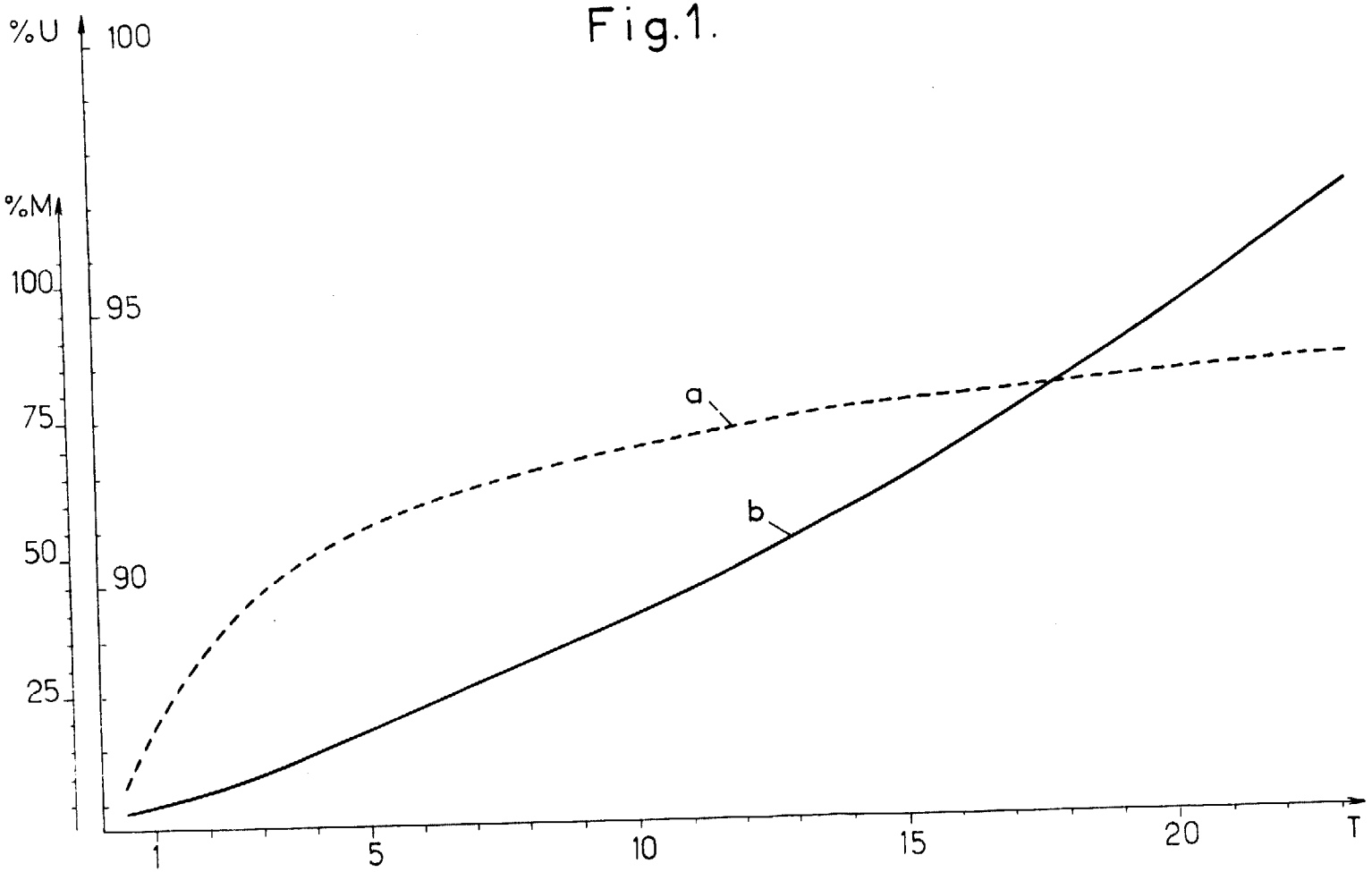
FIG. 1 shows curves representative of the behavior of the uranium and of the organic matter contained in an ore contacted with a leach solution.

Tests were carried out in an autoclave.

The results obtained in a test including a single leach operation only are indicated for the sake of comparison.

These various tests were carried out on Herault ore, of which the analytical characteristics (at least as regards the main components) were the following:

| Analytical data expressed in % by weight | |
|---|---|
| U | 0.3 |
| S | 0.6 |
| organic matter | between 1 and 5 |
| $CO_2$ | 5.5 |
| FeO | 3.60 |
| $Fe_2O_3$ | 1.86 |
| $SiO_2$ | 47.3 |

-continued

| Analytical data expressed in % by weight | |
|---|---|
| $Al_2O_3$ | 16.9 |
| $Na_2$ | 2.0 |
| $K_2O$ | 4.87 |
| CaO | 4.37 |
| MgO | 2.19 |
| $TiO_2$ | 0.6 |

The treatment conditions were the following:

(a) In the comparison test including a single ore-leach only

| | |
|---|---|
| Ratio by weight of the amount of treated ore to the amount of leach solution | = 1 |
| Pressure | = 9 bars |
| Temperature | = 100° C. |
| Concentration of $Na_2CO_3$ and $NaHCO_3$ | = 100 g/l |
| Air flow rate | = 40 $m^3$/h/ton |
| $Fe(OH)_3$ | = 10 kg/t |
| Particle size | = 200 microns |
| Duration | = variable from 1 to 22 hours |

(b) In a two step-test ran according to the invention. In the pre-leach step (first step):

| | |
|---|---|
| Ratio by weight of the amount of treated ore to the amount of pre-leach solution | = 1.05 |
| Pressure | = 2 bars |
| Temperature | = 100° C. |
| Concentration of $Na_2CO_3$ | = 27 g/l |
| Air flow rate | = 25 $m^3$/h/t |
| Duration | = 22 hours |
| $Ca(OH)_2$ | = 14 kg/t |

In the leach-step (second step):

| | |
|---|---|
| Ratio by weight of the amount of treated ore to the amount of leach solution | = 1 |
| Pressure | = 6 bars |
| Temperature | = 140° C. |
| Concentration of $Na_2CO_3$ and $NaHCO_3$ | = 100 g/l |
| Air flow rate | = 25 $m^3$/h/t |
| $Fe(OH)_3$ | = 10 kg/t |
| Duration | variable from 1 to 22 hours |
| Particle size | generally 100 microns |

(2) The solubilization kinetics of uranium

Samples of pre-leach and leach liquors were respectively taken in the course of the pre-leach or leach operations indicated previously, after successive intervals of time, counted in hours from the time at which the leach solutions were contacted with the ore both in the comparison test and in the second step of the test ran within the process according to the invention.

The results are indicated in Table I below:

TABLE I

| Pre-leach (first step) U solubilized % | Leaching in a single operation | two-step leaching |
|---|---|---|
| leach (second step) | | |
| 1 h solubilized U % | | 93.8 |
| 3 | | 94.9 |
| 6 | 90.0 | 95.7 |
| 12 | 92.6 | 96.2 |
| 22 | 95.3 | 96.4 |

This table shows that the "second step" extraction of uranium with an acceptable yield (95 to 96%) is achieved far more rapidly than in the comparison test. An extraction yield of the order of 95% is only obtained in the comparison test after a 22 hour-contact, instead of 6 hours in the "second step" of the process according to the invention.

This result is important if one bears in mind that in the process of the invention, the solubilization of organic matter in the ore treatment is liable of occuring essentially at the level of the second step, in the presence of the leach solution having high contents of sodium carbonate.

(3) Comparison of the relative solubilization kinetics of uranium and organic matter The variations of the proportions (expressed in % in Table II below) of the organic matter which solubilizes in the leach liquor were also recorded as a function of time.

TABLE II

| leach time in hours | U solubilized % | proportions of organic matter dissolved: in % |
|---|---|---|
| 1 h | 87.4 | 4 |
| 2 h | 90.3 | 8 |
| 6 h | 91.0 | 26 |
| 12 h | 92.8 | 48 |
| 22 h | 93.7 | 100 |

The results are also expressed in FIG. 1 by curves a and b, which are respectively representative of the rates of solubilization of the uranium and of the organic components respectively into the leaching medium.

FIG. 1 illustrates the variations according to time T, expressed in hours, of the percentages by weight of uranium dissolved (% U), on the one hand, and of the organic matter extractible from the ore (% M), on the other hand.

Table II and the curves show that:

the solubilization rate of the uranium which initially is relatively high then diminishes, when the leaching time is extended (asymptotic curve), and on the contrary, the proportions of organic matter which is dissolved in the medium, which are small at the beginning, tend to become increasingly important as the leaching time is greater.

The invention takes advantage of solubilization kinetics which are all the more remarkable as the ore had previously been freed of considerable contents of sulfates.

It is possible in fact, after the pre-leaching step, to limit the duration of the second leaching step to about 6 hours, whereby only a reduced proportion of the solubilizable organic matter passes into the solution.

(4) Effect of iron salts on the solubilization yield

It is observed that the addition of iron hydroxide or of the inexpensive natural iron carbonate, have the effect of accelerating still further the solubilization of the uranium in the leach medium. The results obtained are shown in Table III below. Measurements were carried out by way of comparison, as to the proportions of the uranium entering into solution under the same leaching conditions, but in the absence of iron.

TABLE III

| | without oxidant | with $FeCO_3$ or $Fe(OH)_3$ | 20 kg/t 10 kg/t |
|---|---|---|---|
| Preleading U solubilized % | 70.0 | 71.8 | |
| Leaching U solubilized % | | | |
| 1 h | 88.1 | 92.5 | |
| 3 h | 91.7 | 93.9 | |
| 6 h | 92.9 | 95.4 | |
| 12 h | 94.4 | 96.3 | |
| 22 h | 94.4 | 96.9 | |

Two observations may be made from these results:

(1) The presence of iron increases the solubilization rate of uranium (2 to 3% more).

(2) The solubilization yield reachs more rapidly its maximum in the presence of iron, whereby the leaching time can be further reduced.

II—EXAMPLE OF THE CONTINUOUS OPERATION OF THE PROCESS ACCORDING TO THE INVENTION

Figure 2:
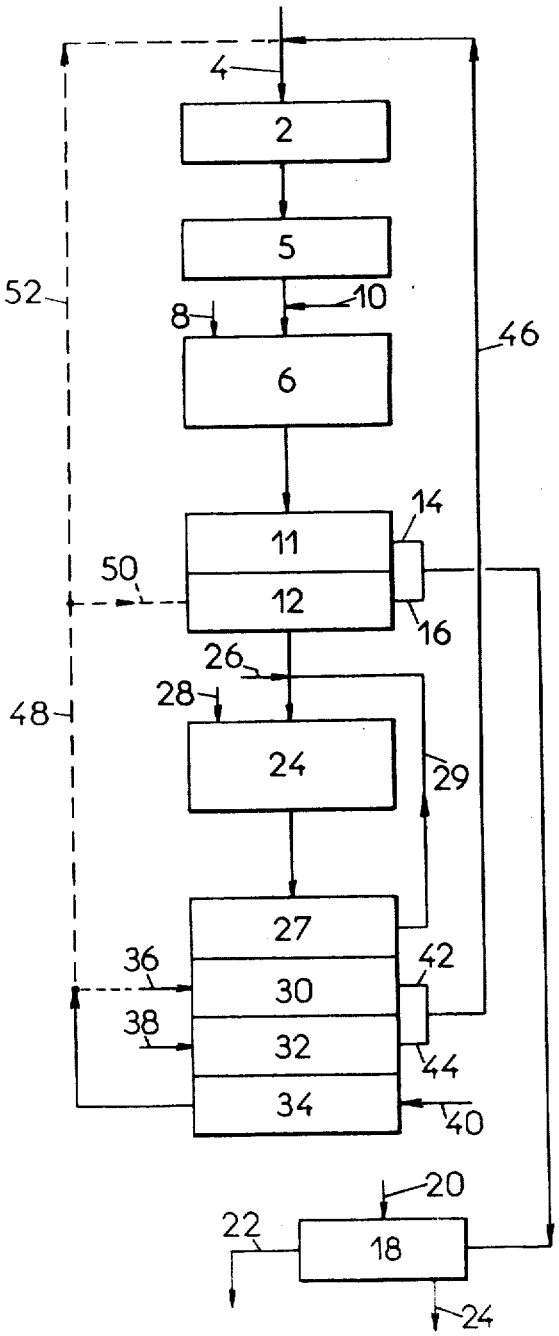
FIG. 2 is a diagrammatic illustration of an installation enabling the process of the invention to be carried out in a continuous manner.

The process of the invention can be carried out in installations, the various elements of which may be of a quite conventional design. Such an installation is diagrammatically shown in FIG. 2.

The ore brought to the divided state in a grinder 2 supplied at 4 with an aqueous medium, such as a dilute alkaline carbonate solution, is then caused to settle into a settler 5 before being introduced into the pre-leaching reactor 6, which is supplied at 8 with an oxidant gas under pressure. Advantageously, lime is introduced at 10.

When the pre-leaching is ended, the suspension contained in the pre-leaching reactor 6 is forwarded to a filtration installation 11, in which the pre-leach liquor is separated from the pre-leached ore.

The ore then passes into a scrubber 12 (which may be distinct from the filtration installation 11 or not).

The filtered pre-leach liquor and the washings which leave the filtration installation and scrubber, at 14 and 16 respectively, are pooled and supplied to a reactor 18 fed at 20 with sodium hydroxide. The residual liquor is sent to the purge 22, while the uranium precipitated in the state of uranate, is collected at 24.

The ore, collected after separation of the pre-leach liquor and the washings, is then conveyed into a second reactor 24, supplied with a concentrated solution of sodium carbonate, at 26, and with air or oxygen under pressure, at 28.

After leaching, the leach liquor is separated from the treated ore, particularly by filtration, at 27 and recycled to the input of the leach reactor, as shown diagrammatically at 29. The treated ore then undergoes three successive washings, in scrubbers shown diagrammatically at 30, 32 and 34 supplied with water, at 36, 38 and 40, respectively. If necessary, the third washing is recycled at 36 to the first scrubber.

In accordance with the preferred embodiment of the invention, the volumes of the solutions introduced into these scrubbers, and more particularly scrubbers 30 and 32, are so adjusted that the washings collected respectively at 42 and 44 form, after they are pooled, a dilute solution of carbonate, which is then recycled, to the input of the installation, to the pre-leaching step, as shown diagrammatically at 46.

Pipes enabling a modified distribution of the liquids, particularly of the recycled washings, to any one of the scrubbers of the first or second step or to the first step input are shown diagrammatically by interrupted lines at 48, 50 and 52, respectively.

Such an installation can operate continuously, the essential part of the dilute carbonate solution required for the carrying out of the first step, being constituted by the washings from the ore, after leaching of the latter, in the second step of the process according to the invention, and separation of the leach liquor. The average compositions and flow rates of the different solutions or suspensions which can be used or formed in such a system, when the process is applied to an ore having an average content of 0.25% of uranium and 0.8% or extractible sulfur, are indicated hereafter by way of example. The operational conditions (the concentrations of the solutions in carbonate, temperatures, pressures) are the preferred ones which have been indicated above.

Determination of the volumes of mineral pulp and liquid:

| | |
|---|---|
| Ratio of liquid to solid at the pre-leaching level | 1.05 |
| Ratio of liquid to solid at the leach level | 1.00 |
| Volume of production (pre-leach liquor) | 1.05 |
| Ratio of the volume of liquid retained in the ore to the mass of the latter, after filtration of the liquors or washings | 0.35 $m^3$/ton |

Determination of the concentrations:

Production liquor (at the output from the pre-leach reactor (6))

| | | |
|---|---|---|
| U | = 2.38 | g/l |
| $Na_2CO_3$ | = 10 | g/l |
| $Na_2SO_4$ | = 33.8 | g/l |

Pre-leach solution (at the input of the pre-leach reactor (6))

| | | |
|---|---|---|
| U | = 1 | g/l |
| $Na_2CO_3$ | = 30.2 | g/l |
| $Na_2SO_4$ | = 12.6 | |

Leach solution (at the input of the leach reactor 24)

| | | |
|---|---|---|
| U | = 2.55 | g/l |
| $Na_2CO_3$ | = 97 | g/l |
| $Na_2SO_4$ | = 28.9 | g/l |

Leach liquor (at the output of the leach reactor 24):

| | | |
|---|---|---|
| U | = 3 | g/l |
| $Na_2CO_3$ | = 90.6 | g/l |
| $Na_2SO_4$ | = 37.8 | g/l |

The solubilization rates are then substantially the following:

At the pre-leaching level:

70 % of uranium

-continued

| |
|---|
| 75 % of sulfur |

At the leaching level:

| |
|---|
| 30 % of uranium<br>25 % of sulfur |

The volume and content of the solution sent to the purge 22 are the following:

| 1050 litres of solution per ton of ore; content of uranium less than 20 mg per litre; | |
|---|---|
| $Na_2CO_3$ | = 10 g/l |
| $Na_2SO_4$ | = 35 g/l |
| NaOH | = 5 g/l. |

The inversion of the proportions of carbonate with respect to the sulfates in the pre-leach and leach solutions, at the output of the pre-leaching and leaching reactors 6 and 24, respectively, must be noted. The pre-leaching liquors are very rich in sulfates, whilst the leach liquors have only a reduced content of sulfates with respect to their respective contents of carbonates, whence the possibility of multiplying the recyclings and of obtaining a better exhaustion of the sodium carbonates of the solutions concomitant with an increased extraction of uranium.

Hence it is found that the process according to the invention enables the elimination of sulfates, without important losses of carbonate. The limited character of the carbonate losses is illustrated by the content of this salt in the purge solution, which is reduced with respect to the total amount of carbonate used by the process.

We claim:

1. In a process for the treatment of an uraniferous ore containing sulfur in the form of sulfates or sulfides, with one or more alkaline solutions containing sodium carbonate, in the presence of an oxidant, for extracting uranium in the form of soluble uranium salt in said solutions, the improvement which comprises subjecting the ore, in a first step, to the action of a dilute pre-leach solution of sodium carbonate, whose concentration does not substantially exceed, or by very little, that which is required for the solubilization of the major part of the sulfur initially contained in the ore to convert it to sulfate in the presence of the oxidant and, in a second step, to the action of a leach solution, more concentrated in sodium carbonate, enabling the extraction and solubilization in the medium of the major part of the uranium still contained in the ore, not extracted in the pre-leach medium of the first step.

2. The process of claim 1, wherein the treated uraniferous ore also contains reducing organic matter or components.

3. The process of claim 2, wherein the treated ore contains at least 0.5% by weight of sulfur and at least 1% by weight of orgnaic matter.

4. The process of claim 3 wherein the ore contains from 0.6 to 1% by weight of sulfur and from 1 to 5% of organic matter.

5. The process of claim 1 wherein the oxidant is gaseous and is formed of air, or oxygen-enriched air or of gas containing oxygen.

6. The process of any of claims 1 to 5 wherein the concentration of sodium carbonate in the dilute pre-leach-solution in said first step is so adjusted as to enable the extraction in the state of sulfate, of the order of 70 to 80%, of the sulfur initially contained in the treated ore.

7. The process of any one of claims 1 to 5, wherein uranium is recovered from a major part of the solution resulting from the pooling of the liquid media obtained at the end of the pre-leaching operation, after separation of the treated ore, and of the washings of this ore.

8. The process of any one of claim 1 to 5, wherein the concentration of sodium carbonate in the pre-leach solution and the volume of the latter, on the one hand, and the volumes of aqueous solution used to effect at least one washing of the ore after the pre-leaching operation, on the other hand, are so adjusted that, having regard to the amounts of the treated ore, the solution obtained upon pooling the pre-leaching liquor obtained as a result of the ore pre-leaching and the washings thereof has a concentration of sodium carbonate ranging from about 10 to about 20 g per liter.

9. The process of claim 8, wherein said uranium is precipitated by sodium hydroxide from the solution obtained upon said pooling of said pre-leaching liquor and said washings.

10. The process of any one of claims 1 to 5 wherein the carbonates in said pre-leach solution are formed of acid sodium carbonate and neutral sodium carbonate, the proportions of which are so adjusted that the pH of the pre-leach solution is kept at a value ranging from about 9.5 to about 10.

11. The process of claim 10, wherein the pH of the pre-leach solution is adjusted by the controlled introdution therein of a hydroxide of a metal other than sodium, said hydroxide being selected among those which enable in addition the conversion of at least part of the reducing acids of the organic matter into salts substantially insoluble at these pH values in the pre-leach solution.

12. The process of claim 11, wherein the hydroxide used is a hydroxide of an alkaline-earth metal.

13. The process of claim 12, wherein the hydroxide used is calcium hydroxide.

14. The process of any one of claims 1 to 5, wherein the concentration of sodium carbonate of the pre-leach solution ranges from about 20 to about 40 g of sodium carbonate per liter, and wherein the concentration of the leach solution ranges from about 70 to about 110 g of sodium carbonate per liter.

15. The process of any one of claims 1 to 5, wherein one at least of the abovesaid leaching and pre-leaching operations is effected in the presence, in the liquid medium, of iron carbonate, iron hydroxide, or a salt capable of releasing iron hydroxide in the medium, in an amount capable of enabling an increase of the rate or uranium extracted and dissolved in the extraction medium.

16. The process of any one of claims 1 to 5 which is continuous and wherein at least part of the leach liquor obtained after the second step leaching is recycled continuously to the leaching of fresh charges of ore.

17. The process of any one of claims 1 to 5 wherein the pre-leach solution in said first step, is formed in part of a recycled solution obtained upon pooling the washings of the ore, after treatment of the latter by the leach solution, in the course of the abovesaid second step, the volumes of aqueous solution used in the course of these latter washing operations being so adjusted, having regard to the mass of treated ore, that the pooled solution has the suitable concentration of sodium carbonate for said pre-leach solution.

18. The process of any one of claim 1 to 5 which comprises maintaining the contact of the ore with the pre-leach solution, at a temperature ranging from about 100° C. to about 140° C. for from about 3 to about 12 hours.

19. The process of any one of claim 1 to 5 which comprises maintaining the contact of the ore with the leach solution, at a temperature ranging from about 120° C. to about 140° C. for from about 3 to about 7 hours.

20. The process of claim 9 wherein the carbonates in said pre-leach solution are formed of acid sodium carbonate and neutral sodium carbonate, the proportions of which are so adjusted that the pH of the pre-leach solution is kept at a value ranging from about 9.5 to about 10.

21. The process of claim 1 which is continuous and wherein the pre-leach solution is said first step, is formed in part of a continuously recycled solution obtained upon pooling the washings of the ore, after treatment of the latter by the leach solution in the course of the abovesaid second step, the volumes of aqueous solution used in the course of these latter washing operations being so adjusted, having regard to the mass of treated ore, that the pooled solution has the suitable concentration of sodium carbonate for said pre-leach solution.

22. The process of claim 21 wherein the concentration of sodium carbonate of the pre-leach solution ranges from about 20 to about 40 g of sodium carbonate per liter, and wherein the concentration of the leach solution ranges from about 70 to about 110 g of sodium carbonate per liter.

23. The process of claim 22 which comprises maintaining the contact of the ore with the pre-leach solution, at a temperature ranging from about 110° C. to about 140° C. for from about 3 to about 12 hours and maintaining the contact of the ore with the leach solution, at a temperature ranging from about 120° C. to about 140° C. for from about 3 to about 7 hours.

24. The process of any one of claim 21 to 23 which comprises continuously adjusting the pH of the pre-leach solution at a value ranging from about 9.5 to about 10 by the controlled introduction therein of calcium hydroxide.

25. The process of any one of the claims 21 to 23 wherein one at least of the abovesaid leaching and pre-leaching operations is effected in the presence, in the liquid medium, of iron carbonate, iron hydroxide, or a salt capable of releasing iron hydroxide in the medium, in an amount capable of enabling an increase of the rate of uranium extracted and dissolved in the extraction medium.

26. The process of any one of claim 21 to 23 wherein uranium is recovered from a major part of the solution resulting from the pooling of the liquid media obtained at the end of the pre-leaching operation, after separation of treated ore, and of the washings of this ore and wherein at least part of the leach liquor obtained after the second step leaching is recycled continuously to the leaching of fresh charges of ore.

* * * * *